United States Patent [19]

Brackmann

[11] Patent Number: 4,566,470

[45] Date of Patent: Jan. 28, 1986

[54] TOBACCO LEAF PROCESSING

[75] Inventor: Warren A. Brackmann, Mississauga, Canada

[73] Assignee: Rothmans of Pall Mall Canada Limited, Don Mills, Canada

[21] Appl. No.: 545,859

[22] Filed: Oct. 27, 1983

[30] Foreign Application Priority Data

Oct. 28, 1982 [GB] United Kingdom ..... 8230812

[51] Int. Cl.[4] ..... A24B 3/18

[52] U.S. Cl. ..... 131/312; 131/290

[58] Field of Search ..... 131/290, 300, 297, 298, 131/303, 311, 312

[56] References Cited

U.S. PATENT DOCUMENTS 4,392,501 7/1983 Newton et al. ..... 131/290

*Primary Examiner*—V. Millin

*Attorney, Agent, or Firm*—Sim & McBurney

[57] ABSTRACT

Tobacco leaf is processed into a form suitable for use in the manufacture of cigarettes by first cutting the leaf into strips, air classifying the strips into a lamina fraction and a stem fraction, threshing the stem fraction to separate lamina associated with the stem, and cutting the lamina strips and the separated lamina into shreds. The stem also may be processed for blending with the lamina shreds.

7 Claims, 1 Drawing Figure

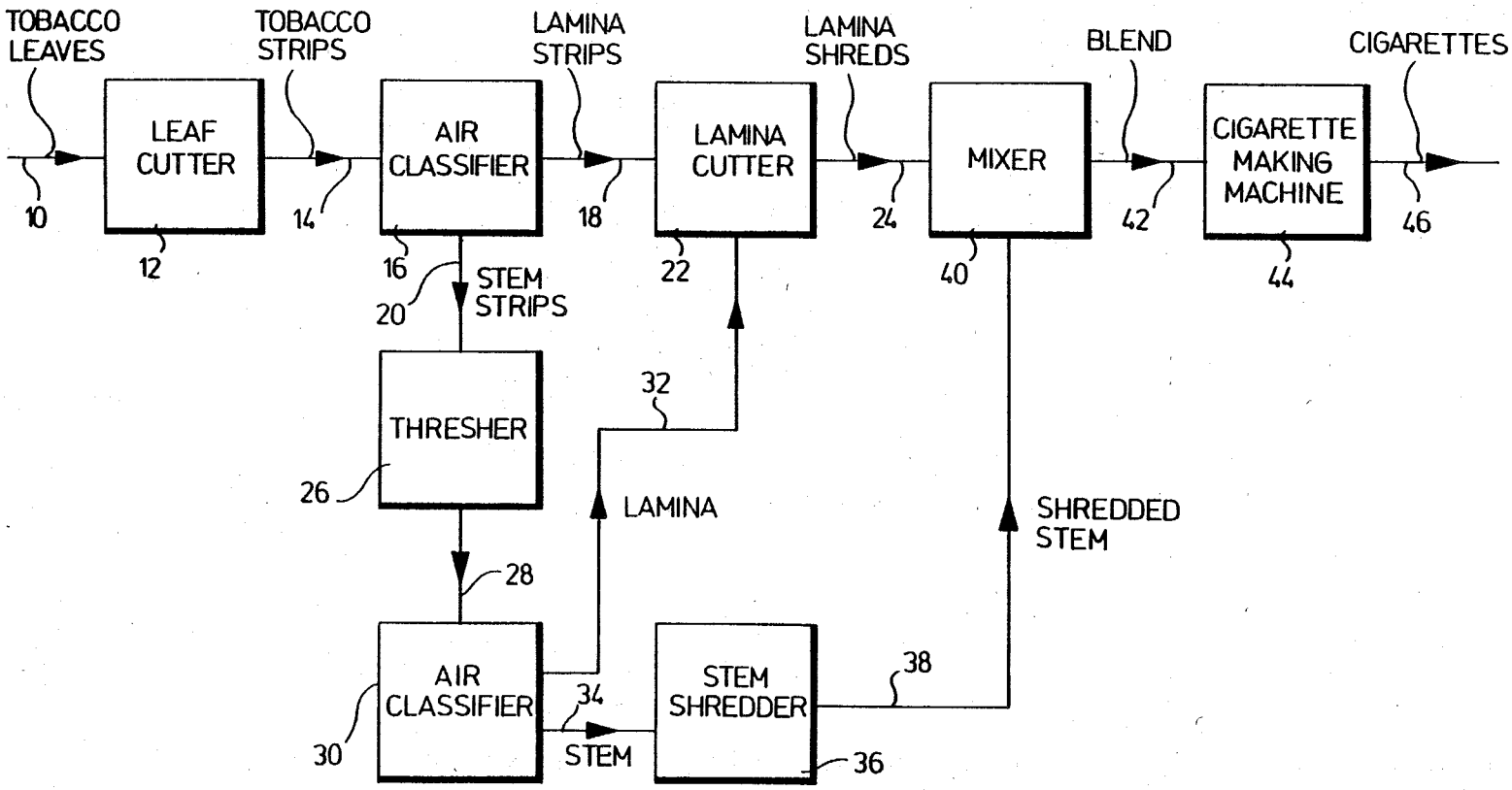
TOBACCO LEAVES
10
LEAF CUTTER
12
TOBACCO STRIPS
14
AIR CLASSIFIER
16
LAMINA STRIPS
18
STEM STRIPS
20
LAMINA CUTTER
22
LAMINA SHREDS
24
THRESHER
26
28
AIR CLASSIFIER
30
32
LAMINA
STEM
34
STEM SHREDDER
36
38
SHREDDED STEM
MIXER
40
BLEND
42
CIGARETTE MAKING MACHINE
44
CIGARETTES
46

TOBACCO LEAF PROCESSING

FIELD OF INVENTION

The present invention relates to tobacco leaf processing and more particularly to the formation of cigarettes from leaf tobacco.

BACKGROUND TO THE INVENTION

In prior U.S. Pat. No. 4,233,996, assigned to the assignee herein, there is described a tobacco leaf processing operation wherein the tobacco leaf is simultaneously subjected to cuts perpendicular to one another to form tobacco particles of cigarette rod-forming dimensions, the tobacco particles resulting from the cutting operations are air classified to remove the heavier particles having stem associated therewith from the lighter lamina particles, the heavier particles usually are threshed to separate the stem from lamina particles connected thereto, and the lamina particles resulting from the threshing usually are mixed with the lighter lamina particles resulting from the classification to provide tobacco particles which are suitable for direct formation of cigarettes therefrom without the necessity for further shredding or shred shortening operations.

The mass of tobacco shreds which results from the cutting step must be disentangled prior to air classification. The disentangling operation can lead to shortening of some of the tobacco shreds as a result of the pressures applied to the shreds as they are drawn apart. Shortening of the tobacco shreds decreases the filling power of the tobacco, and this is undesirable. Further, the threshing operation requires multiple threshing and separation to effect complete separation of the lamina material from stem, and these steps create much dust and many particles which are not suitable for subsequent cutting and use in finished cigarettes.

SUMMARY AND GENERAL DESCRIPTION OF INVENTION

In accordance with the present invention, this prior art problem is overcome by first cutting the tobacco leaf into strips, preferably of a width corresponding to the length of shreds ultimately required for cigarette formation, usually about 0.5 to about 0.75 inches (about 1.3 to about 1.9 cm). The tobacco leaves preferably are oriented with respect to the cutting knives so that the leaves are cut longitudinally, so that the central stem is associated with a single tobacco strip. Any convenient cutting equipment may be used to effect the cutting of the tobacco leaf into strips.

The relatively small number of tobacco pieces, in the form of strips, which results from the strip cutting operation, and the association of the heavier stem material with one of the strips enables the tobacco strips to be readily and rapidly classified into lamina strips and the heavier central stem strip, without the necessity for the disentangling operation of the prior art. The tobacco degradation and loss of filling power resulting therefrom are eliminated.

The lamina material then is cut to form shreds suitable for feed to a cigarette making machine. The cutting may be randomly oriented. The cuts are effected to establish the width of the shreds, and usually is about 0.02 to about 0.05 inches (about 0.05 to about 0.13 cm).

The tobacco strip containing the stems is threshed to remove the lamina material associated therewith. The separated lamina is forwarded to the lamina cutting step. The relatively uniform size of the strip which is threshed enables complete lamina and associated stem to be separated in a decreased number of threshing and separating steps when compared with the prior art.

The stem material which results from the threshing step may be subjected to processing for use in cigarette making by known procedures. As set forth in U.S. Pat. No. 4,386,617, assigned to the assignee herein, the stem material may be fiberized using closely-spaced counter-rotating disks to form fibrous shredded stem material, which is suitable for combining with shredded lamina to form a cigarette maker feed.

The shredded stem material may be forwarded to storage, if desired, for blending with the lamina shreds, or a blend of lamina shreds, after conditioning, if desired, at a later date when it is desired to use the lamina shreds in cigarette making. Any convenient mixing procedure may be used to blend the lamina shreds and shredded stem, such as that described in our published U.K. patent application No. 8304899 filed Feb. 22, 1983, in the name of the assignee herein.

The procedure of the present invention, therefore, constitutes an improvement over that described in prior U.S. Pat. No. 4,233,996, in that the procedures are simplified and filling power degradation is avoided. The procedure of the invention may be used to process individual leaves sequentially or a plurality of leaves simultaneously.

BRIEF DESCRIPTION OF DRAWING

The single FIGURE of the accompanying drawing is a schematic flow sheet of the preferred embodiment of the invention.

DESCRIPTION OF PREFERRED EMBODIMENT

Referring to the drawing, tobacco leaves, usually conditioned using conventional moistening procedures, are fed by line 10 to a cutter 12 wherein the tobacco leaves, after orienting so that at least a substantial majority of the leaves is oriented longitudinal of the cutters. In the cutter 12, the tobacco leaves are cut into elongate tobacco strips, which leave the cutter by line 14.

The tobacco strips then are classified in an air classifier 16 to separate a lighter fraction comprising lamina strips in line 18 and a heavier fraction comprising stem strips having lamina attached thereto.

The lamina strips are passed to a second cutter 22 wherein the strips are cut to form tobacco shreds in line 24 of dimensions suitable for cigarette making, without the necessity for any further cutting or shortening procedures.

The heavy fraction in line 20 is forwarded to a threshing and separation operation 26, wherein the stem particles are threshed to separate the lamina material attached thereto. The threshed material is forwarded by line 28 to an air classifier 30 for classification into a lighter lamina fraction and into a heavier stem fraction. Multiple threshing and air classification operations usually are effected.

The lamina fraction is forwarded by line 32 to the lamina cutter 22, while the stem fraction is forwarded by line 34 to a stem shredder 36 comprising closely-spaced fiberizing plates. In the stem shredder 36 the stems are processed to form shredded stem material, which is forwarded by line 38 to a mixer 40 wherein it is mixed with lamina shreds in line 24 to form a blend in line 42 for feed to a cigarette-making machine 44, wherein cigarettes in line 46 are formed from the blend.

The illustrated procedure is schematic. It will be understood that in practice shredded lamina and shredded stem may be stored for considerable periods of time prior to cutting or to mixing and that shredded lamina of many grades of tobacco usually are combined to form the final blend from which the cigarettes are formed.

SUMMARY OF DISCLOSURE

In summary of this disclosure, the present invention relates to a tobacco leaf processing procedure for forming cigarette maker feed which is an improvement over the procedure of U.S. Pat. No. 4,233,996. Modifications are possible within the scope of this invention.

What I claim is:

1. A method of processing leaf tobacco, which comprises:

cutting said tobacco leaf into a plurality of tobacco strips;

classifying said plurality of strips into a heavier fraction and a lighter fraction;

threshing said heavier fraction strips to separate stem material from lamina material; and cutting said lighter fraction strips and said lamina material to form lamina shreds, said tobacco leaf being oriented so that the first-mentioned cutting step is effected longitudinally of the leaf.

2. A method of processing leaf tobacco, which comprises:

cutting said tobacco leaf into a plurality of tobacco strips;

classifying said plurality of strips into a heavier fraction and a lighter fraction;

threshing said heavier fraction strips to separate stem material from lamina material; and cutting said lighter fraction strips and said lamina material to form lamina shreds, a plurality of tobacco leaves being simultaneously processed and said plurality of leaves being manipulated so that at least a substantial majority of the leaves is cut longitudinally of the leaf in the first-mentioned cutting step.

3. A method of processing leaf tobacco, which comprises:

cutting said tobacco leaf into a plurality of tobacco strips;

classifying said plurality of strips into a heavier fraction and a lighter fraction;

threshing said heavier fraction strips to separate stem material from lamina material; and cutting said lighter fraction strips and said lamina material to form lamina shreds, said plurality of tobacco strips having a lateral dimension of about 0.5 to about 0.75 inches.

4. A method of processing leaf tobacco, which comprises:

cutting said tobacco leaf into a plurality of tobacco strips;

classifying said plurality of strips into a heavier fraction and a lighter fraction;

threshing said heavier fraction strips to separate stem material from lamina material; and cutting said lighter fraction strips and said lamina material to form lamina shreds, the light fraction and said lamina material being cut to form shreds having a thickness of about 0.02 to about 0.05 inches.

5. A method of processing leaf tobacco, which comprises:

cutting said tobacco leaf into a plurality of tobacco strips;

classifying said plurality of strips into a heavier fraction and a lighter fraction;

threshing said heavier fraction strips to separate stem material from lamina material; and cutting said lighter fraction strips and said lamina material to form lamina shreds, shredding said stem material from the threshing step to form shredded stem material, and mixing said shredded stem material with said lamina shreds.

6. A method of processing leaf tobacco, which comprises:

orienting a plurality of tobacco leaves to provide at least a substantial majority of said leaves extending in approximately the same direction, cutting said oriented tobacco leaves longitudinally of said leaves to form a plurality of tobacco strips having a width of about 0.5 to about 0.75 inches, air classifying the tobacco strips into a lighter fraction comprising substantially tobacco lamina strips and a heavier fraction comprising substantially strips of tobacco lamina attached to stem, threshing said heavier fraction strips to separate the lamina material from the stem material, air classifying the threshed material to separate a lighter lamina fraction from the heavier stem fraction, cutting the lighter lamina fraction and the separated lamina into tobacco shreds having a thickness of about 0.02 to about 0.05 inches, shredding the stem material to form shredded stem material, and blending the shredded stem material with the tobacco shreds.

7. The method of claim 6 wherein said shredding of stem material is effected by counter-rotating fiberizing surfaces.

* * * * *